United States Patent [19]

Kler et al.

[11] Patent Number: 4,926,087

[45] Date of Patent: May 15, 1990

[54] CAVITY DISCHARGE IGNITER

[75] Inventors: Chandra M. Kler, Wembley; Jagdevinder S. Hanspal, Iver, both of England

[73] Assignee: Smiths Industries Public Limited Company, London, England

[21] Appl. No.: 278,982

[22] Filed: Dec. 2, 1988

[30] Foreign Application Priority Data

Dec. 5, 1987 [GB] United Kingdom ..... 8728491

[51] Int. Cl.[5] ..... H01T 13/32; H01T 13/50; H01T 13/54

[52] U.S. Cl. ..... 313/131 A; 313/138; 313/141; 123/169 EL

[58] Field of Search ..... 313/131 A, 130, 141, 313/142, 138; 123/169 EL

[56] References Cited

U.S. PATENT DOCUMENTS 2,657,248 10/1953 Smits ..... 313/131 A
2,831,993 4/1958 Lentz ..... 313/131 A

FOREIGN PATENT DOCUMENTS 656021 8/1951 United Kingdom .
1018963 2/1966 United Kingdom .
2060773 5/1981 United Kingdom .

*Primary Examiner*—Kenneth Wieder
*Attorney, Agent, or Firm*—Pollock, Vande Sande and Priddy

[57] ABSTRACT

An electrical igniter has an outer metal shell within which extends a semiconductive tubular pellet that provides a cylindrical cavity which opens through an orifice formed by an inturned lip of the shell which forms a first electrode of the igniter. The diameter of the cavity and the diameter of the orifice are in the ratio of about 5 to 6. A second electrode extends axially within the shell into the rear end of the pellet with which it makes electrical contact. Discharge between the first and second electrodes causes a plasma of discharge products produced in the cavity to be ejected through the orifice.

7 Claims, 1 Drawing Sheet

CAVITY DISCHARGE IGNITER

BACKGROUND OF THE INVENTION

This invention relates to igniters.

The invention is more particularly concerned with semiconductor, surface-discharge igniters of the cavity kind, that is, in which discharge in initiated within a cavity of the igniter.

The principle behind the operation of cavity discharge igniters is that the discharge within a cavity causes an expansion of substances in the cavity, leading to projection of an ignition plasma out of the tip. Because the plasma is ejected from the igniter, ignition of a fuel/air mixture, such as in a gas-turbine enginem can occur at some distance from the igniter tip. This has some advantages, such as enabling the igniter to be located at a distance from the ignition zone, in a cooler region where the igniter will have a longer life. Previous semiconductor cavity discharge igniters have been proposed with a cylindrical pellet of semiconductor material with a central bore that defines the discharge path between two electrodes. One electrode is located within the bore recessed back from the end of the pellet, while the other electrode is provided by the outer shell of the igniter which extends laterally across the forward end of the pellet and is formed with a central orifice axially aligned with the bore through the pellet. In this way, the discharge path occurs between the central, recessed electrode and the circular edge of the orifice, over the cylindrical surface of the pellet bore. In previous igniters, the orifice is selected to have a diameter that is the same as, or smaller than, that of the semiconductive discharge cavity so that expansion of gases and vapour is confined in the cavity to a certain extent and a high velocity jet of plasma is projected through the orifice.

The usefulness of these previous igniters, however, has been limited to relatively low airflows and relatively high fuel/air ratios.

BRIEF SUMMARY OF THE INVENTION

It is an object of the present invention to provide a semiconductive, surface discharge cavity igniter of improved performance.

According to the present invention there is provided an electrical igniter having a cavity at its operative tip, a semiconductor surface discharge path within the cavity, a first electrode located at one end of the discharge path, a second electrode located at the other end of the discharge path, and an outlet orifice opening from said cavity at the operative tip through which discharge produced in the cavity are ejected, the cross-sectional area of the outlet orifice being greater than the lateral cross-sectional area of the cavity.

It has been found, contrary to expectations and previous configurations, that igniters with an outlet orifice that is larger than the discharge cavity are able to produce ignition at significantly lower fuel/air ratios and at greater airflows than igniters with an orifice that is smaller than, or equal to, the discharge cavity.

Preferably, the semiconductive discharge path is provided by the surface of a semiconductive tubular member which may be of circular section. The outlet orifice may be of circular shape with the diameter of the cavity and the diameter of the orifice being in the ratio of about 5 to 6. The second electrode may extend within the tubular member and make electrical contact with its internal surface. The outlet orifice is preferably provided by the first electrode which may be formed by an inturned lip of a metal shell within which the cavity is located.

An electrical igniter for a gas-turbine engine, in accordance with the present invention, will now be described, by way of example, with reference to the accompanying drawings.

DETAILED DESCRIPTION

Figure 1:
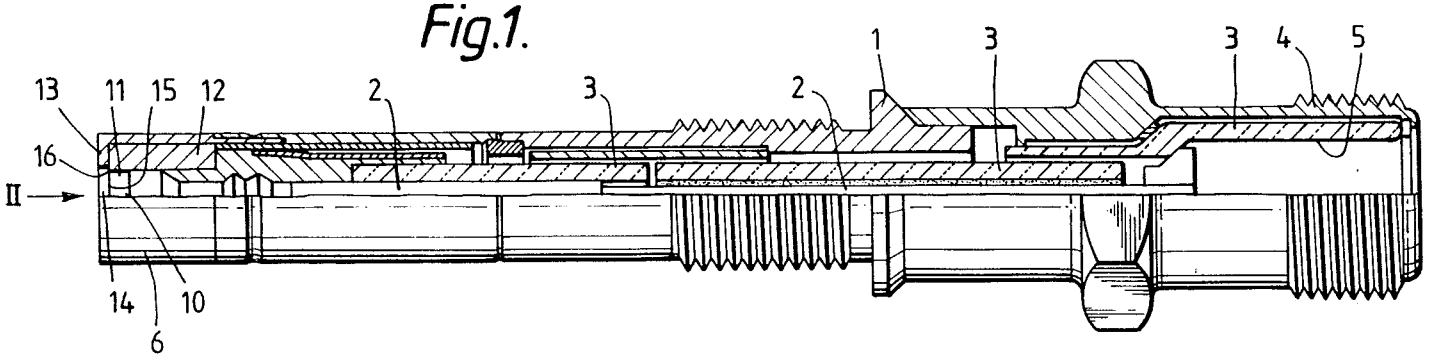
FIG. 1 is a partly sectional side elevation of the igniter.

The cavity discharge igniter of the present invention has an outer shell 1 of stainless steel or a nickel alloy that is of generally tubular shape and circular section and which provides the outer electrode of the igniter. The inner electrode 2 is of tungsten or a nickel alloy and takes the form of a generally cylindrical rod that extends axially within the outer shell 1 and that is insulated from the outer shell by ceramic insulating sleeves 3. At the rear end 4 of the igniter the outer shell 1 is threaded to receive an electrical connector (not shown) that makes connection to both the outer shell 1 and to the rear end of the inner electrode 2 that is set forward within a recess 5 at the rear of the igniter. Between opposite ends of the igniter, the outer shell 1 is provided with surface formations that serve in mounting the igniter in the wall of a gas-turbine engine.

The forward end, or operative tip 6, of the igniter includes a cavity 10 within which discharge is caused. The cavity 10 is defined by the bore 11 through a tubular pellet 12 of a semiconductor such a silicon carbide ceramic. The pellet 12 is of circular section, the bore 11 extending axially through it and being of diameter about 5 mm. The pellet 12 is located in the outer shell 1 forwardly of the insulating sleeves 3 and in electrical contact with the outer shell. The inner electrode 2 extends into the rear end of the bore 11, making good electrical contact with the surface of the bore. The length of the cavity 10 between the forward end of the inner electrode 2 and the forward end of the pellet 11 is about 3 mm.

The pellet 12 is retained securely in the operative tip 6 of the igniter by an inturned lip 13 of the outer shell 1 that extends radially inwardly at the tip of the igniter. The inner edge of the lip 13 defines a circular orifice 14 of diameter about 6 mm and depth 2 mm. It can be seen that, because the orifice 14 is of larger diameter than the cavity 10, the inner circular edge 15 of the pellet 12 will be exposed, and that an annular ledge 16 will be formed by the forward end of the pellet around the rear end of the orifice 14.

When a voltage of about 2.8 kv is applied between the inner and outer electrodes 1 and 2, discharge occurs between the forward end of the inner electrode 2 and the cylindrical surface defining the orifice 14 over the cylindrical inner semiconductive surface of the pellet 12 and around its edge 15.

Figure 3:
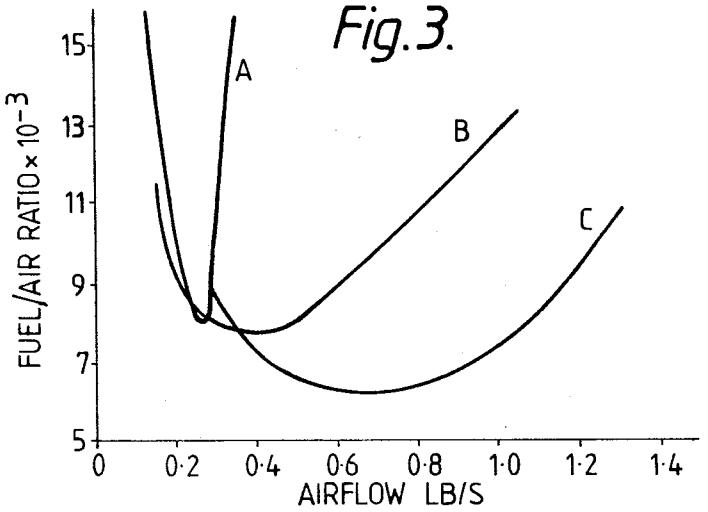
FIG. 3 illustrates the performance of the igniter of the present invention, and the performance of two other igniters of different configuration.
Figure 2:
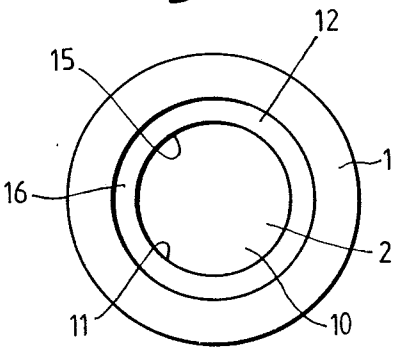
FIG. 2 is an enlarged end view of the igniter of FIG. 1 along the arrow II.

It was found that an igniter of this kind exhibited considerably better performance at low fuel/air ratios and at high airflows than igniters having smaller orifices. This is illustrated in FIG. 3 in which the curves A to C represent the boundaries for the different igniters beyond which reliable ignition is not possible. The curves illustrate atmospheric combustion in the combustor of a typical aircraft gas-turbine engine with AVTUR fuel.

Curve A illustrates the performance of an igniter with an orifice cross-sectional area smaller than that of the cavity, from which it will be seen that ignition is not possible reliably when the fuel/air ratio is below about $8\times10^{-3}$ or when the airflow is greater than about 0.35 lb/s.

Curve B illustrates the performance of an igniter with an orifice of the same cross-sectional area as that of the cavity. With this configuration, ignition is possible at greater airflow, but there is no substantial reduction in the lower limit of the fuel/air ratio.

The third Curve C illustrates the performance of an igniter of the kind described above in which the cross-sectional area of the orifice is greater than the lateral cross-sectional area of the cavity. It will be seen that this igniter has the best performance, enabling ignition down to fuel/air ratios of around $6\times10^{-3}$ and with airflows greater than 1–2 lb/s.

The reason for this unexpected result is not clear, but is thought it may be because the discharge path is pulled laterally around the end of the semiconductive pellet, leaving the central part of the orifice open for free ejection of the discharge products (expanding gases, vapours and plasma) from the igniter. The more open construction to the cavity may also help any liquid fuel or the like to be removed readily from the cavity, so that a greater proportion of the electrical energy, on subsequent discharges, is utilized in the production of plasma than in vaporizing and removing liquid products in the cavity.

It will be appreciated that igniter tips of different dimensions and configurations can be used in different applications providing that the cross-sectional area of the orifice is greater than the lateral cross-section of the cavity.

What is claimed is:

1. In an electrical cavity discharge igniter of the kind having a cylindrical cavity at its operative tip, a semiconductive surface discharge path along said cavity, a first electrode located at one end of the discharge path, a second electrode located at the other end of the discharge path, and an outlet orifice opening from said cavity at the operative tip through which a plasma of discharge products produced in said cavity are ejected for ignition of a fuel-air mixture at a distance from said igniter, the improvement wherein the diameter of the cavity and the diameter of the outlet orifice are in the ratio of about 5 to 6.

2. An electrical igniter according to claim 1, including a semiconductive tubular member, said semiconductive discharge path being provided by a surface of said semiconductive tubular member.

3. An electrical igniter according to claim 2, wherein the semiconductor tubular member is of circular section.

4. An electrical igniter according to claim 2, wherein the second electrode extends within the semiconductive tubular member and makes electrical contact with an internal surface of said semiconductor tubular member.

5. An electrical igniter according to claim 1, wherein the outlet orifice is provided by the first electrode.

6. An electrical igniter according to claim 5, wherein the igniter includes a metal shell, said cavity being located within said shell, and said first electrode being formed by an inturned lip of the shell.

7. An electrical cavity discharge igniter comprising: an outer metal shell providing a first electrode of the igniter; a semiconductive tubular member located within said outer metal shell and providing a cylindrical cavity within said semiconductive tubular member; a second electrode extending axially within said outer shell into said semiconductive tubular member to make electrical contact with an internal surface of said semiconductive tubular member; and an outlet orifice from said cavity formed by said outer shell at an operative tip of the igniter such that discharge between said first and second electrodes over the internal surface of said semiconductive tubular member causes a plasma of discharge products produced in said cavity to be ejected through said orifice for ignition of a fuel-air mixture at a distance from said igniter, the diameter of said cylindrical cavity and the diameter of said outlet orifice being in the ratio of about 5 to 6.

* * * * *